US007178609B2

(12) United States Patent
Hart et al.

(10) Patent No.: US 7,178,609 B2
(45) Date of Patent: Feb. 20, 2007

(54) WINDOW MILL AND DRILL BIT

(75) Inventors: Daniel Hart, Sugarland, TX (US); Calvin Stowe, II, West University Place, TX (US); Trung Huynh, Houston, TX (US); Roy E. Swanson, Sugarland, TX (US); Rustom K. Mody, Bellaire, TX (US); Jack T. Oldham, Willis, TX (US); Jeffrey Lund, The Woodlands, TX (US); Lawrence Allen Sinor, Conroe, TX (US); Robert A. Laing, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 191 days.

(21) Appl. No.: 10/916,342

(22) Filed: Aug. 10, 2004

(65) Prior Publication Data

US 2005/0039905 A1 Feb. 24, 2005

Related U.S. Application Data

(60) Provisional application No. 60/496,636, filed on Aug. 19, 2003.

(51) Int. Cl.
*E21B 7/04* (2006.01)

(52) U.S. Cl. ..... 175/61; 166/55.1; 166/298

(58) Field of Classification Search ..... 175/61, 175/379; 166/55.1, 298
See application file for complete search history.

(56) References Cited

U.S. PATENT DOCUMENTS

| | | | | |
|---|---|---|---|---|
| 5,887,668 | A * | 3/1999 | Haugen et al. | 175/79 |
| 5,979,571 | A | 11/1999 | Scott et al. | |
| 6,131,675 | A | 10/2000 | Anderson | |
| 6,612,383 | B2 | 9/2003 | Desai et al. | |
| 2001/0035302 | A1 | 11/2001 | Desai et al. | |
| 2001/0040054 | A1 | 11/2001 | Haugen et al. | |

* cited by examiner

*Primary Examiner*—William Neuder
(74) *Attorney, Agent, or Firm*—Gerald W. Spinks

(57) ABSTRACT

A method and apparatus for running a whipstock into a well bore attached to a combination mill and drill bit, releasing the mill/bit from the whipstock, milling a window in the casing, and drilling a lateral well bore, all in one trip. The mill/bit is provided with a primary cutting structure better suited for milling through the casing, and a secondary cutting structure, better suited for drilling through the earth formation. The secondary cutting structure is initially smaller in diameter than the primary cutting structure. The whipstock can be attached to the mill/bit with a shear bolt supported by a boss on the whipstock, with the boss designed to arrest axial motion of the mill/bit after shearing of the bolt.

4 Claims, 2 Drawing Sheets

WINDOW MILL AND DRILL BIT

CROSS REFERENCE TO RELATED APPLICATIONS

This application claims the benefit of U.S. Provisional Pat. App. No. 60/496,636, filed Aug. 19, 2003, for "Window Mill and Drill Bit".

STATEMENT REGARDING FEDERALLY SPONSORED RESEARCH OR DEVELOPMENT

Not Applicable

BACKGROUND OF THE INVENTION

1. Field of the Invention

This invention is in the field of apparatus used to mill a window through the wall of a casing in an oil or gas well, to allow for the drilling of a lateral bore hole.

2. Background Art

It is common in some oil or gas wells to drill a lateral bore hole extending out to the side of a vertical bore hole, usually for the purpose of accessing specific formations at different depths. This is often done by running a whipstock into the borehole and setting it at the desired depth. Setting of, the whipstock is followed by rotating a window mill in the borehole and following the curve of the whipstock through the casing wall, along a large radius path established by the whipstock. Once the window mill has penetrated the casing wall and created the window, the window mill is typically removed from the borehole and replaced by a drill bit which is then used to drill the lateral bore.

It is expensive to trip a work string in and out of a borehole for the purpose of installing the whipstock, running in the window mill, and running in the drill bit. It would be desirable to have a method and apparatus for accomplishing all of these operations in one trip.

BRIEF SUMMARY OF THE INVENTION

The present invention provides a method and apparatus for running a whipstock into a borehole, bolted to the side of a combination mill and drill bit. The combination mill/bit has a more durable primary cutting structure suitable for milling out the window in the casing, and a harder secondary cutting structure suitable for drilling through the earth formation after the casing window is formed. The mill/bit is designed so that the secondary cutting structure is prevented from contact with the casing during milling, but exposed to contact with the earth formation after penetration of the casing. This can be accomplished by designing the primary cutting structure to initially contact the casing wall, rather than the secondary cutting structure. In addition, the primary cutting structure can be designed to wear away at a rate which exposes the secondary cutting structure to contact the earth formation shortly after the casing has been penetrated. A boss is provided on the whipstock to support the attachment bolt which connects the whipstock to the mill/bit, and a relief area is provided in the side of the mill/bit to accommodate the boss on the whipstock.

The apparatus is run into the well on a work string, and the whipstock is set at the desired depth. The work string is then set down onto the apparatus, shearing the attachment bolt. The downward movement of the mill/bit is arrested by contact between an upper shoulder in the relief area on the mill/bit with the boss on the whipstock. A side shoulder in the relief area also contacts the boss to limit rotation of the mill/bit after the bolt is sheared. This prevents the mill/bit from rotating during or after the shearing step, ensuring that the upper shoulder of the relief area strikes the boss squarely. The mill/bit can then be raised until the side shoulder clears the boss, then rotated to mill away the boss and continue on down the whipstock to penetrate the casing and form a window. After penetration of the casing, continued rotation of the mill/bit wears away the primary cutting structure to expose the secondary cutting structure to the earth formation.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
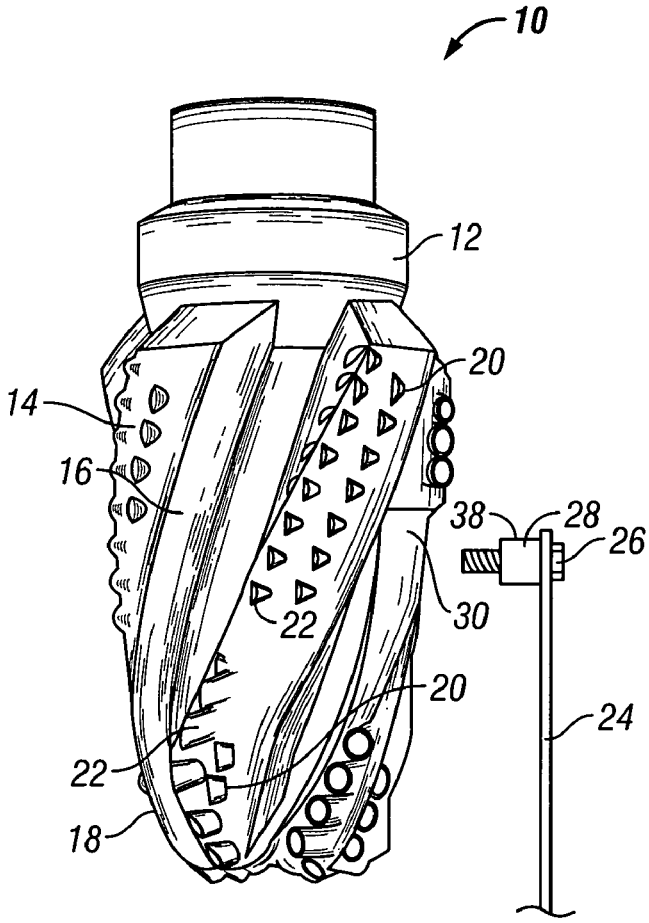
FIG. 1 is an elevation view of the apparatus according to the present invention.

As shown in FIG. 1, the apparatus 10 of the present invention includes a combination mill and drill bit 12 which is adapted to have its upper end attached to a work string. The work string could be any type of work string suitable for orienting and setting a whipstock in place, and then rotating the mill/bit. Around its periphery, the mill/bit 12 has a plurality of blades 14 formed thereon or attached thereto. Each blade 14 can be oriented substantially parallel to the longitudinal axis of the mill/bit 12, or each blade 14 can be angled with respect to the mill/bit axis as shown. Each blade 14 has an upper section 16 closer to the upper end of the mill/bit 12, and a lower section 18 closer to the lower end or face of the mill/bit 12. The upper section 16 of each blade 14 can have an outer edge which is tapered at a relatively smaller angle than the outer edge of the lower section 18 of the blade 14. For example, the outer edge of the upper section 16 of each blade 14 can be tapered at approximately 6 degrees relative to the longitudinal axis of the mill/bit 12, and the outer edge of the lower section 18 of each blade 14 can be tapered at approximately 20 degrees relative to the longitudinal axis of the mill/bit 12, down to the face of the mill/bit 12. The upper and lower sections of the blade can also be angled at different angles relative to the longitudinal axis.

Each blade 14 can have a primary cutting structure 20 and a secondary cutting structure 22, with the primary cutting structure 20 being formed of cutting inserts of a relatively more durable material, such as tungsten carbide, and with the secondary cutting structure 22 being formed of cutting inserts of a relatively harder material, such as polycrystalline diamond (PDC). The material used in the primary cutting structure 20 is selected to make it more effective at milling through the steel casing, while the material used in the secondary cutting structure 22 is selected to make it more effective at drilling through the earth formation, particularly through rock. As the mill/bit 12 is initially made, the outside diameter of the primary cutting structure 20 is greater than the outside diameter of the secondary cutting structure 22 in any given plane orthogonal to the longitudinal axis of the mill/bit 12.

Figure 2:
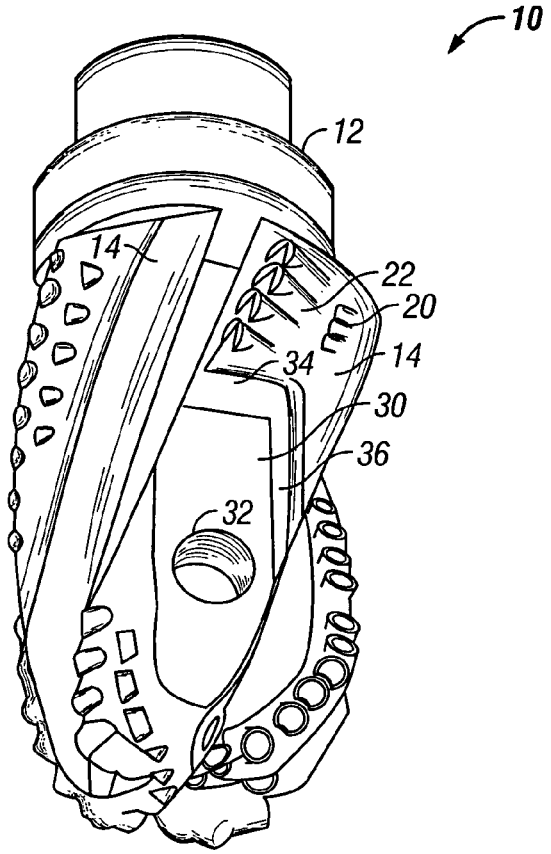
FIG. 2 is a perspective view of the combination mill/bit shown in FIG. 1.

The mill/bit 12 is attached to the upper end of a whipstock 24, by means of a bolt 26. The bolt 26 is shaped and sized as is commonly known in the art to shear under a known shear stress. A boss 28 is formed at the upper end of the whipstock 24, surrounding the bolt 26, to lend lateral support to the bolt 26, keeping the bolt 26 substantially perpendicular to the upper end of the whipstock 24. A recess or relief area 30 is provided in the side of the mill/bit 12, to receive the boss 28. As seen better in FIG. 2, a hole 32 is provided in the side of the mill/bit 12 to receive the bolt 26. The hole 32 is positioned so that there is some clearance between the upper face 38 of the boss 28 and the upper face or shoulder 34 of the recess 30. A lateral face or shoulder 36 of the recess 30 can abut a lateral face of the boss 28.

With the whipstock 24 attached to the side of the mill/bit 12, and the entire apparatus 10 attached to a work string, the apparatus 10 is run into the borehole to the desired depth, where the whipstock 24 is oriented to the desired azimuth and anchored in place. Weight is then applied to the mill/bit 12, until the bolt 26 shears. After shearing of the bolt 26, axial movement of the mill/bit 12 is arrested by abutment of the upper face 34 of the recess 30 with the upper face 38 of the boss 28. The lateral shoulder 36 prevents rotation immediately upon shearing, thereby ensuring that the upper shoulder 34 strikes the boss 28 squarely. If the upper shoulder 34 did not strike the boss 28 squarely, the upper shoulder 34 could jump to the side of the boss 28 and wedge against the side of the boss 28. This would make the mill/bit 12 difficult to raise after the shearing step.

After the downward movement of the mill/bit 12 is arrested by squarely contacting the boss 28, the mill/bit 12 is raised until the lateral face 36 of the recess 30 clears the upper end of the boss 28, and rotation of the mill/bit 12 is then commenced. As the mill/bit 12 rotates, the mill/bit 12 is lowered, and the primary cutting structure 2 mills away the boss 28. As the mill/bit 12 continues rotation, it is further lowered to follow the whipstock 24 through a large radius curve, as the primary cutting structure 20 contacts and mills through the casing wall (not shown). As the mill/bit 12 is rotated during its initial use, the casing wall will be contacted by the primary cutting structure 20, rather than by the secondary cutting structure 22.

The primary cutting structure 20 is designed to wear away shortly after penetrating the casing wall and contacting the earth formation outside the casing, until the secondary cutting structure 22 contacts the earth formation. Continued rotation and lowering of the mill/bit 12 causes the secondary cutting structure 22 to form the desired lateral bore hole in the earth formation. The primary cutting structure 20 can also be designed to wear to a desired diameter which is slightly less than the diameter of the secondary cutting structure 22, in any given plane orthogonal to the axis of the mill/bit 12. Thereafter, the worn primary cutting structure 20 acts to limit the rate of penetration of the secondary cutting structure 22 into the earth formation, and to dynamically stabilize the mill/bit 12 by a non-cutting contact between the worn primary cutting structure 20 and the borehole wall.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A combination milling and drilling apparatus, comprising:

a tool body attachable to a work string;

primary and secondary cutting structures on said tool body, said primary cutting structure being relatively more suitable for milling through metal, said secondary cutting structure being relatively more suitable for drilling through earth, said primary cutting structure having a larger diameter than said secondary cutting structure in any given plane perpendicular to the longitudinal axis of said tool body;

a whipstock;

a releasable fastener adapted to attach said whipstock to said tool body;

a raised boss on said whipstock; and a recess on said tool body, said recess being adapted to receive said boss.

2. The apparatus recited in claim 1, wherein said primary cutting structure is adapted to wear away to a smaller diameter than said secondary cutting structure, in any given plane perpendicular to the longitudinal axis of said tool body, upon rotating contact with an earth formation.

3. A one-trip method for milling a casing window and drilling a lateral well bore, comprising:

providing a rotatable cutting tool with a larger diameter primary cutting structure suitable for milling through metal, and a smaller diameter secondary cutting structure suitable for drilling through earth;

lowering said cutting tool into a cased borehole, with a whipstock attached to said cutting tool by a releasable fastener;

setting said whipstock in place at a desired depth and azimuthal orientation;

releasing said releasable fastener to release said cutting tool from said whipstock;

rotating said cutting tool to mill a casing window with said primary cutting structure;

wearing away said primary cutting structure to a smaller diameter than said secondary cutting structure, by contact with an earth formation; and rotating said cutting tool to drill a lateral well bore with said secondary cutting structure;

wearing away said primary cutting structure to a smaller diameter than said secondary cutting structure;

limiting rate of penetration of said secondary cutting structure through said earth formation by non-cutting contact between said worn primary cutting structure and said earth formation; and dynamically stabilizing said cutting tool by non-cutting contact between said worn primary cutting structure and said earth formation.

4. A one-trip method for milling a casing window and drilling a lateral well bore, comprising:

providing a rotatable cutting tool with a larger diameter primary cutting structure suitable for milling through metal, and a smaller diameter secondary cutting structure suitable for drilling through earth;

lowering said cutting tool into a cased borehole, with a whipstock attached to said cutting tool by a releasable fastener;

setting said whipstock in place at a desired depth and azimuthal orientation;

releasing said releasable fastener to release said cutting tool from said whipstock;

rotating said cutting tool to mill a casing window with said primary cutting structure; wearing away said primary cutting structure to a smaller diameter than said secondary cutting structure, by contact with an earth formation;

rotating said cutting tool to drill a lateral well bore with said secondary cutting structure;

providing a boss on said whipstock and a recess on said cutting tool to receive said boss; and arresting movement of said cutting tool after said release of said releasable fastener, by abutting a face of said recess with a face of said boss.

* * * * *